310-334 SR
XR 3,978,353

United States Patent [19]

Kinoshita

[11] 3,978,353

[45] Aug. 31, 1976

[54] PIEZOELECTRIC ACOUSTIC SPEAKER SYSTEM

[75] Inventor: Shouzo Kinoshita, Tokorozawa, Japan

[73] Assignee: Pioneer Electronic Corporation, Tokyo, Japan

[22] Filed: May 6, 1975

[21] Appl. No.: 574,983

[30] Foreign Application Priority Data

May 10, 1974 Japan ..... 49-53106[U]

[52] U.S. Cl. ..... 310/8.1; 179/110 A; 307/88 ET; 310/8.2; 310/9.1; 310/9.8

[51] Int. Cl.[2] ..... H01L 41/08

[58] Field of Search ..... 310/8.2, 8.5, 8.6, 8, 310/9.4, 9.5, 9.6; 179/110 A, 111 R; 307/88 ET

[56] References Cited

UNITED STATES PATENTS

| | | | |
|---|---|---|---|
| 1,753,137 | 4/1930 | Seibt | 179/111 R |
| 2,678,967 | 5/1954 | Grosskopf | 179/111 R |
| 3,832,580 | 8/1974 | Yamamuro et al. | 310/9.5 |

FOREIGN PATENTS OR APPLICATIONS

| | | | |
|---|---|---|---|
| 6,801,923 | 8/1969 | Germany | 179/110 A |

*Primary Examiner*—Mark O. Budd
*Attorney, Agent, or Firm*—Woodhams, Blanchard and Flynn

[57] ABSTRACT

A Piezoelectric speaker system with a piezoelectric diaphragm supported in a cylindrical form and provided with a plurality of vibration regions, which is capable of controlling the directional characteristics by easy operation according to necessity or listener's preference.

14 Claims, 8 Drawing Figures

PIEZOELECTRIC ACOUSTIC SPEAKER SYSTEM

This invention relates to a piezoelectric speaker system employing a diaphragm made of a piezoelectric film and imparted with a resiliency and/or tension for making vibration in the direction normal to the plane thereof. The invention is more particularly concerned with a piezoelectric speaker system of this type with a diaphragm supported in a cylindrical form and provided with a plurality of vibration regions each having electrodes bonded or deposited onto both surfaces thereof, which is adapted to produce a sound pressure through expanding and contracting action of the diaphragm according to application of signals to the electrodes of the diaphragm.

It has been proposed to provide a speaker of non-directional characteristics by employing a piezoelectric diaphragm supported in a cylindrical form. In this context, the present invention has been achieved to meet a demand for a speaker which is capable of easily controlling the directional patterns or characteristics ranging from non-directional patterns to unidirectional patterns. The control of the directivity to permit variant directional patterns is desirable not only to adjust it according to necessity but also to meet a listener's personal preference or a condition of a listening room.

It is therefore an object of the present invention to provide a piezoelectric speaker system having a piezoelectric diaphragm supported in a cylindrical form and provided with a plurality of vibration regions to selectively obtain, by easy operation, desired directional characteristics or patterns according to a purpose of use or a listener's preference or taste.

It is another object of the present invention to provide a piezoelectric speaker system of this type which is capable of varying directional characteristics or patterns by selectively actuating the vibration regions.

It is a further object of the present invention to provide a piezoelectric speaker system of this kind which is capable of varying directional characteristics or patterns by applying signals of different phases to the respective vibration regions.

It is a still further object of the present invention to provide a piezoelectric speaker system of this kind which is capable of varying directional characteristics or patterns by applying signals of different levels to the respective vibration regions.

It is a still further object of the present invention to provide a piezoelectric speaker system of this kind which is capable of varying directional characteristics or patterns by applying signals of different phases and levels to the respective vibration regions.

According to the present invention, there is provided a piezoelectric speaker system comprising a cylindrical substructure assembly; one or more piezoelectric films with holding means connected to the both ends of the or each film; said holding means being engaged with said cylindrical substructure assembly to hold the or each film around said substructure assembly while imparting a predetermined tension to the or each film, thereby to form a cylindrical diaphragm; and a plurality of electrodes provided on each side of the diaphragm to form vibration regions of the number corresponding to the number of said electrodes.

The invention will be better understood from the following description taken in connection with the accompanying drawings in which.

In the drawings and the following descriptions, like portions or parts are denoted by like numerals or characters.

Referring now to FIGS. 1 to 4, there is illustrated one embodiment of the present invention. Numeral 1 generally indicates a substructure assembly and numeral 2 designates a diaphragm assembly with a diaphragm made of a thin film of high molecular weight polymers having piezoelectricity and flexibility and supported by the substructure assembly 1 in the cylindrical form.

Figure 2:
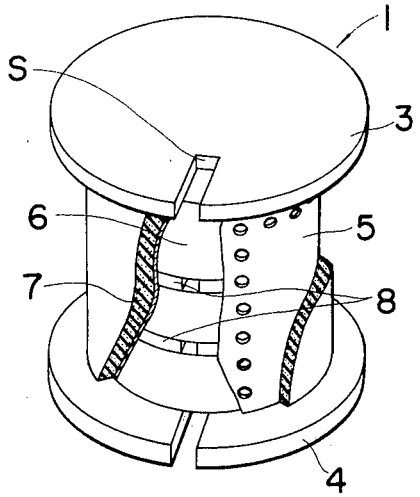
FIG. 2 is a partially cutaway perspective view of one form of the substructure assembly according to the present invention.

The substructure assembly 1 is formed of, as examplarily shown in FIG. 2, a pair of circular base plate members 3 and 4 which are arranged in parallel with each other, a cylindrical suspension member 5 having aplurality of small openings and connecting said base plate members 3 and 4, a sound absorber member 6 made of sound absorbing materials such as glass wool etc. and packed in said cylindrical member 5 and a resilient backing member 7 fitted around the periphery of the cylindrical member 5 to impart a resiliency and/or tension to the diaphragm for its vibration in the direction normal to the plane thereof.

The inside of the cylindrical member 5 may preferably be divided into a plurality of chambers by means of partition members 8 made of felt etc. and disposed in parallel with the base plate members 3 and 4. The partition members 8 may be arranged in the cylindrical member 5 in another suitable way for example in parallel with the axis of said cylindrical member 5 so as to suitably divide the inside of the cylindrical member 5 to small chambers. The thus formed small chambers in the cylindrical member 5 serve to well increase a resonance frequency in the cylindrical member 5, providing a desired sound absorption effect by a less amount of sound absorber 6 as compared to a cylindrical suspension member having no partitions.

Figure 3:
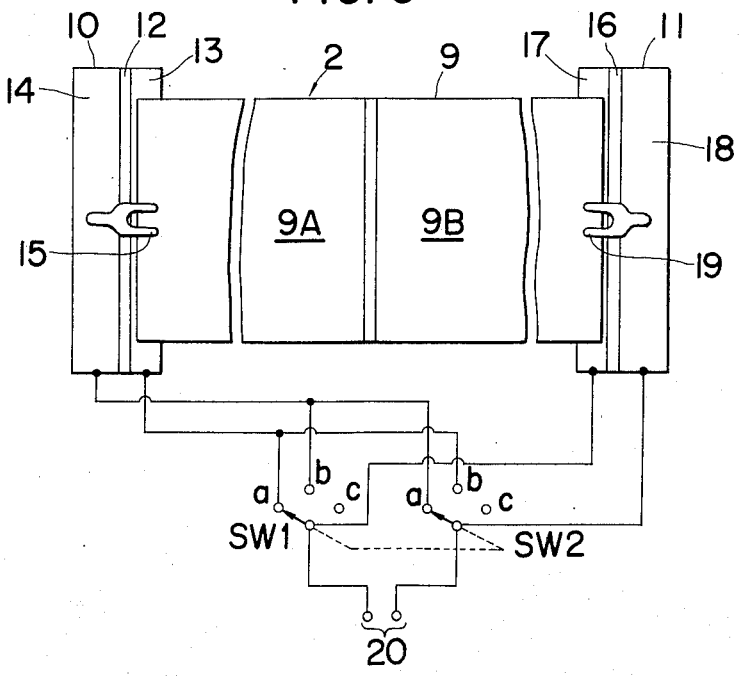
FIG. 3 is a development view showing one form of the diaphragm assembly and a circuitry means therefor according to the present invention.
Figure 4:
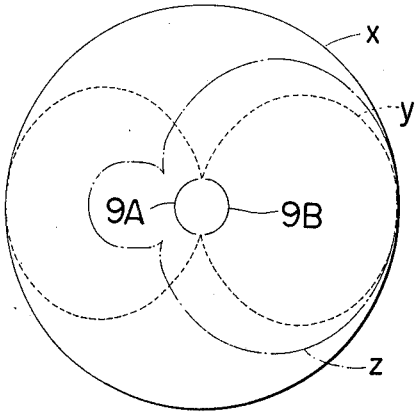
FIG. 4 is a diagram showing the directional patterns or characteristics obtained by the structure of FIG. 3.

The diaphragm assembly 2 includes, as shown in FIG. 3 and mentioned above, the diaphragm made of a thin film of high molecular weight polymer materials subjected to a treatment to have a piezoelectricity, such as a film of polyvinyliden fluoride ($PVF_2$), polyvinyl fluoride (PVF), polyvinyl chloride (PVC), nylon-11 or polypeptide (PMG), etc., and holders 10 and 11 fixed to the ends of said film 9. On the both sides of the film 9 there are bonded or deposited metals like aluminum etc., as electrodes. Said film 9 is fitted around and supported by the substructure assembly 1 in the cylindrical form so as to conform the direction of the expansion and contraction of the film 9 to the circumferential direction of the substructure assembly 1, and provided with two electrodes on each side thereof which are electrically separated from each other at the central portion of the film length in the circumferential direction of the film 9 to define vibration regions 9A and 9B. The holder 10 for the vibration region 9A has, at its one side, a pair of conductive means 13 and 14, such as printed conductor etc., adjacent to each other through a groove or insulator means 12. To the conductive means 13 is connected the electrode of the inner side of the vibration region 9A by conductive adhesives and to the conductive means 14 is connected the electrode of the outer side of the vibration region 9B through a terminal 15. Similarly, the holder 11 for the region 9B is provided with conductive means 17 and 18 separated by a groove or insulator means 16. The conductive means 17 is connected to the electrode of the inner side of the region 9B through conductive adhesives and the conductive means 18 is connected to the electrode of the outer side of the region 9B.

Figure 1:
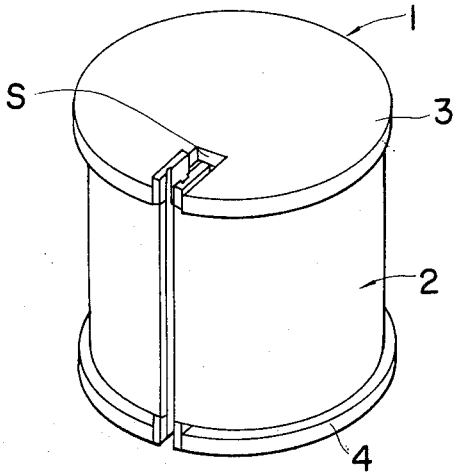
FIG. 1 is a perspective view of one form of the speaker according to the present invention.

In mounting of the vibration member 2 on the substructure assembly 1 as shown in FIG. 1, the holder 11 is engaged with a slit S formed on the substructure assembly 1, the film 9 is fitted around the resilient backing member 7 while pressing and fastening the resilient member 7 and then the holder 10 is put into the slit S.

Since the resilient member 7 is liable to be subjected to one-sided or locally increased pressure by the film 9 which is fitted thereto as mentioned above, there may be caused a problem that the diaphragm is not properly set or not uniformly fitted around the resilient member 7. This problem, however, may be solved and the diaphragm may be imparted with substantially uniform tension and/or resiliency all around the circumference of the resilient member 7 by rubbing the diaphragm in a direction opposite to the direction of the pressure applied.

The conductive means 13, 14, 17 and 18 are connected, as illustratively shown in FIG. 3, to an input terminal 20 through interlocking switch means $SW_1$ and $SW_2$ which are interlocked with each other to operate conjointly. It will be seen in the circuit diagram of FIG. 3, when movable contacts of the switch means $SW_1$ and $SW_2$ are connected to a fixed contact *a*, the region 9A and the region 9B are connected in parallel with each other in the same polarities. The polymer film 9 supported in a cylindrical form, then, vibrates to expand and contract outward and inward, respectively like breathing exercise to provide substantially uniform directional pattern or characteristics, to wit, non-directional characteristics in a plane perpendicular with the axis of the film 9 supported in a cylindrical form, as shown by *x* of FIG. 4. When the movable contact is connected to a fixed contact *b*, the corresponding electrodes of the vibration regions 9A and 9B are connected in opposite polarities and the sound waves radiated thereby are cancelled each other at the boundary portions of the regions 9A and 9B to provide a FIG. 8-like directional pattern or characteristic as shown by *y* of FIG. 4. When the movable contact is switched to a fixed contact *c*, only the region 9B is applied with an input signal and the directivity appears confinedly at the region 9B to form a directional pattern as shown by *z* of FIG. 4, thus providing unidirectional characteristics. The sound field formed in the ⅄-shape at the region 9A is due to the phenomenon that the vibration at the region 9B appears through the resilient backing member 7 and the sound absorber 6.

In the foregoing embodiment, an input signal is selectively applied to either of the vibration regions 9A and 9B or input signals of different phases are applied to the respective regions 9A and 9B to vary or control the directional patterns or characteristics. In this connection, it is to be noted that further variant directional patterns or characteristics can be obtained by applying input signals different in levels as well as in phases to the respective regions 9A and 9B.

Figure 5:
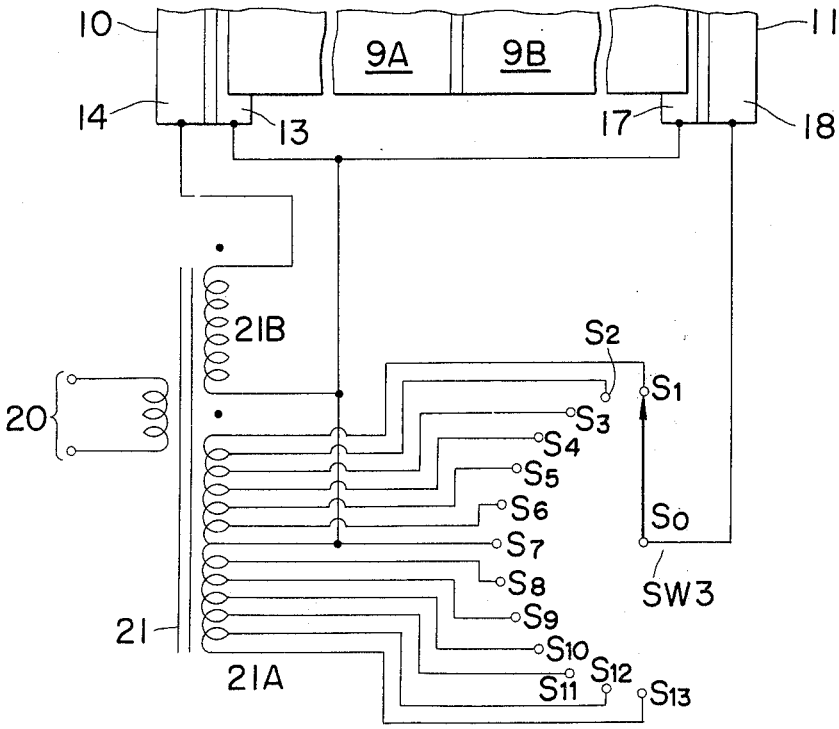
FIG. 5 is another form of the vibrating means and a diaphragm assembly therefor according to the present invention.
Figure 7:
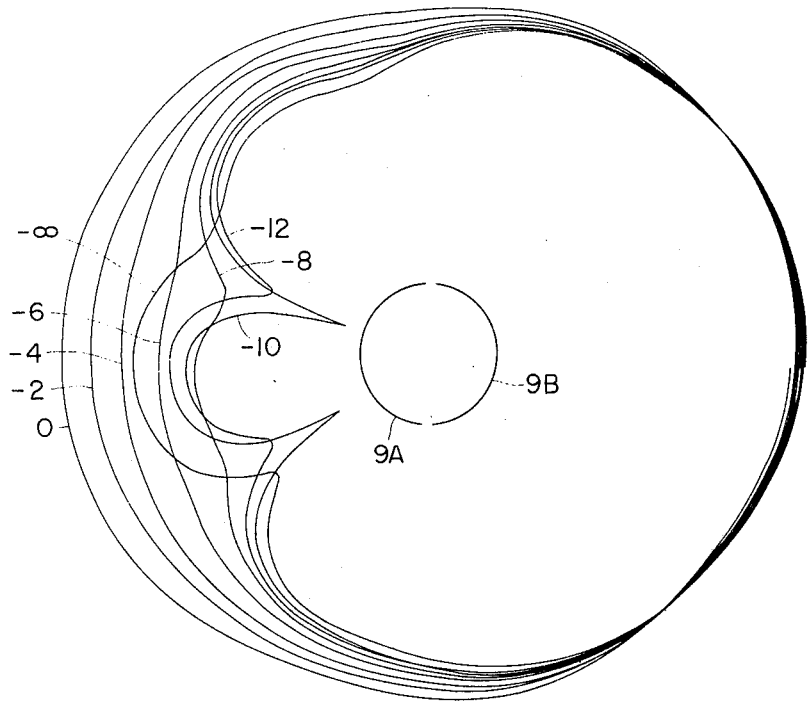
FIG. 7 is a diagram for showing the directional patterns or characteristics obtained by the structure of FIG. 5.
Figure 8:
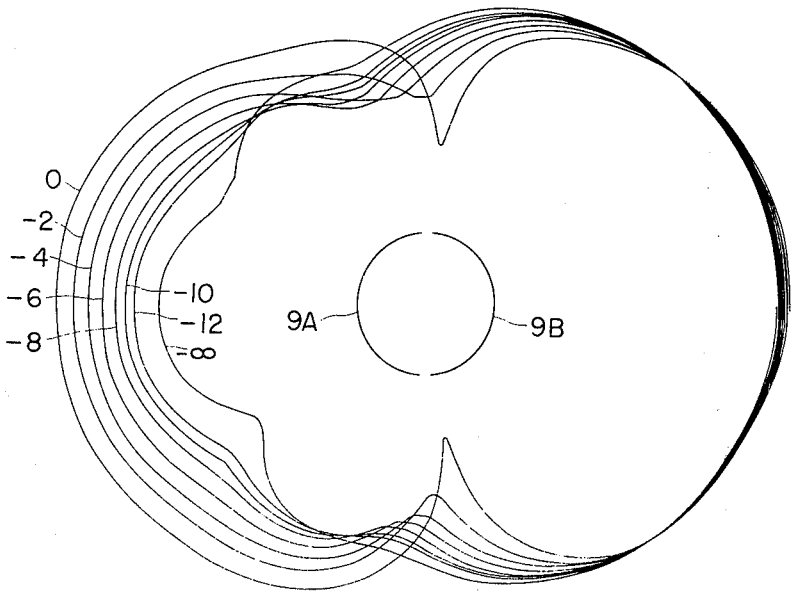
FIG. 8 is another diagram for showing the directional patterns or characteristics obtained by the structure of FIG. 5.

In FIG. 5, there is illustrated another embodiment of the present invention in which vibration regions 9A and 9B are adapted to be applied with input signals of different phases and levels. Stated illustratively, a transformer 21 and a selector switch $SW_3$ are connected through appropriate circuit means to make the input signals to be applied to the respective regions 9A and 9B differ in phases by an electrical angle of 180° are vary in levels. The transformer 21 has secondary coil windings 21A and 21B each for respective system. The number of turns of the coil winding 21A is twice the number of turns of the coil winding 21B. The coil winding 21A has a plurality of taps including an intermediate tap at predetermined intervals. In the circuit connecting the transformer 21, the selector switch $SW_3$ and the electrodes of the respective vibration regions 9A and 9B, one output terminal of the secondary coil winding 21B is connected to conductive means 14 for the vibration region 9A and another output terminal is connected to the intermediate tap of the secondary coil winding 21A, to a conductive means 13 for the vibration region 9A and to a conductive means 17 for the vibration region 9B. Each tap of the secondary coil winding 21A is connected to respective fixed contact $S_1$ to $S_{10}$ of the selector switch $SW_3$. A movable contact $S_0$ of said switch $Sw_3$ is connected to a conductive means 18 for the vibration region 9B. In the thus formed construction, by switching the selector switch $SW_3$, for example by connecting the movable contact $S_0$ to the fixed contact $S_1$, the signal voltage applied to the region 9A is of of the same phase and level as of the signal voltage applied to the region 9B to provide non-directional patterns or characteristics. When the movable contact $S_0$ is switched to the contact $S_7$ which is connected to the intermediate tap of the secondary coil winding 21A, the signal voltage applied to the electrode of the region 9A is nullified and only the region 9B is actuated to present uni-directional patterns or characteristics. Further, the movable contact $S_0$ is connected to the contact $S_{13}$, the signal voltage applied to the regions 9A and 9B are of same levels but opposite phases to present 8-like directional patterns or characteristics. The contacts $S_1$ to $S_6$ are provided for varying the levels of the signal voltages but keeping the signals in the same phase while the contacts $S_8$ to $S_{12}$ are provided to differentiate levels of the signal voltages in the opposite phases. The directional patterns or characteristics thus obtained are shown in FIGS. 7 and 8. FIG. 7 shows the directional patterns or characteristics obtained by connecting the contact $S_0$ to the contacts $S_1$ to $S_5$ and FIG. 7 shows the directional patterns or characteristics obtained by connecting the contact $S_0$ to the contacts $S_7$ to $S_{10}$. In FIGS. 7 and 8, the numerals given to the respective characteristic curves indicate attenuation amount (dB) of the signal voltage applied to the vibration region 9A with reference to the signal voltage applied to the vibration region 9B.

Figure 6:
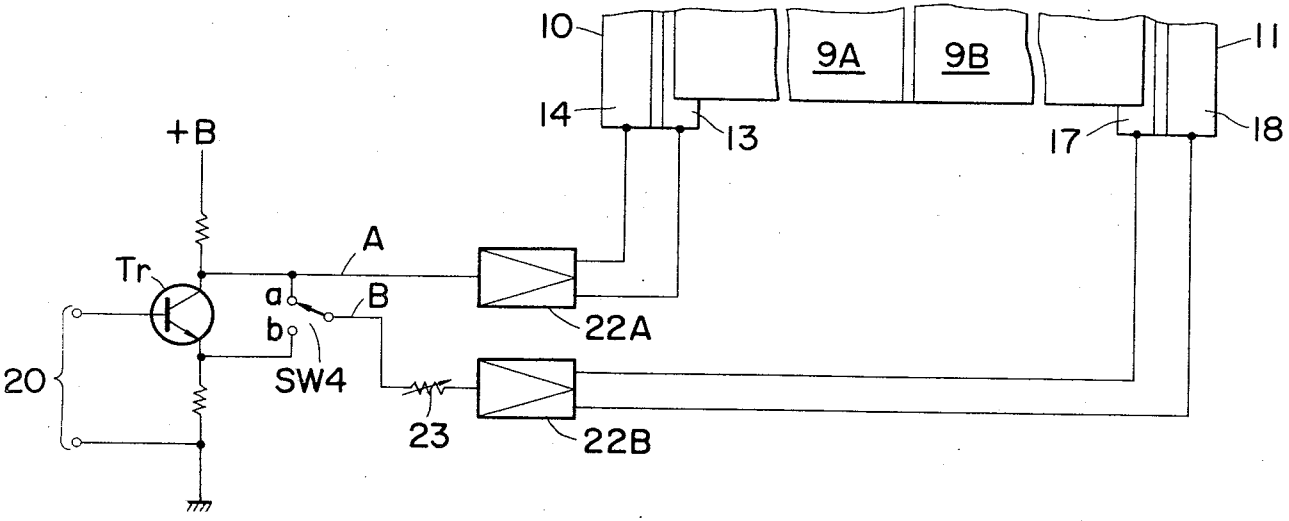
FIG. 6 is a further form of the diaphragm assembly and a circuitry means therefor according to the present invention.

FIG. 6 shows a further embodiment of the present invention, where an electronic circuitry is employed to vary signals to be applied to the regions 9A and 9B both in phases (by an electrical angle of 180°) and levels. More particularly, there are provided signal systems A and B. The signal system A is connected to a transistor T*r* at its collector and the signal system B is connected to said transistor Tr through a selector switch $SW_4$ which is connected between the collector and an emitter of said transistor T*r* so as to be selectively connected to either of the collector and the emitter of the transistor T*r*. The signal system A is connected to electrodes of region 9A through an amplifier 22A and the signal system B is connected to electrodes of region 9B through a variable resistor 23 and an amplifier 22B. The signals applied to the regions 9A and 9B are of the same phases when a movable contact of the selector switch $SW_4$ is connected to a contact *a* and of the opposite phases (keeping an electrical angle of 180°)when it is connected to a contact *b* and the signal voltages are varied in levels by adjusting the variable resistor 23.

As mentioned above, variant or multiform directional patterns or characteristics can be obtained by selectively applying signals to either one of the vibration region 9A or 9B or by applying to the respective regions 9a and 9B with signals of different phases and/or different levels, to present unique sound characteristics including acoustic characteristics.

In this connection, it is further to be noted that a plurality of film members fitted around the substructure assembly to form a cylindrical diaphragm may be employed to provide a plurality of vibration regions instead of employing one film member having a plurality of vibration regions as mentioned in the foregoing embodiments or that a plurality of film members each having a plurality of vibration regions and fitted around the substructure assembly to form a cylindrical diaphragm may be employed to provide further complicated variant directional patterns or characteristics.

It is still further to be noted that the resilient backing member 7 is not necessarily required for the speaker of this invention. In other words, such a resilient member may be replaced with any suitable means for importing a resiliency and/or tension to a diaphragm.

What is claimed is:

1. A piezoelectric acoustic speaker system comprising:

a cylindrical substructure assembly;

at least one piece of piezoelectric film and a holding means connected to adjacent film ends and engaged with said cylindrical substructure assembly to hold said film around the substructure assembly under a predetermined tension and in the form of cylindrical diaphragm;

pairs of electrodes, each having an electrode on the outside of said diaphragm and a further electrode on the inside of said diaphragm, and forming vibration regions of number corresponding to the number of electrode pairs, at least two said independently responsive electrode pairs being circumferentially offset on said cylindrical substructure;

input terminal means for receiving an acoustically reproduceable, alternating input signal;

alternating signal path means establishing a first connection of said input signal terminal means to the electrodes of said at least two electrode pairs for applying alternating input signals related in a first magnitude and phase relation to said two electrode pairs;

switch means interposed in said alternating signal path means and switchable to instead establish at least one differing second connection of said input signal terminal means and pair electrodes for applying alternating input signals related in a second and different relation to said electrode pairs, thereby differently directing sounds reproduced by said speaker system.

2. The speaker system of claim 1, in which said two pairs of electrodes are on opposite circumferential sides of said cylindrical substructure so as to provide diametrally oppositely facing and separately energizable semicircular sound radiators, said switch means including movable conductive element means shiftable for changing at least one of the phase and voltage of the alternating in put signal applied to said at least one of said electrode pairs thereby positively changing the directional response pattern of said speaker system at least in the diametral plane thereof.

3. The speaker system of claim 1, in which said cylindrical substructure assembly includes a cylindrical suspension member having a plurality of small openings therethrough, a pair of base plate members spaced axially by and connected by said suspension member, sound absorbing material packed in said cylindrical suspension member, resilient means between said cylindrical suspension member and at least radiating portions of said diaphragm, and means securing the diaphragm ends with respect to said base plate members for maintaining circumferential tension on said diaphragm.

4. The speaker system of claim 3, including a plurality of felt-like partition members disposed within said cylindrical suspension member and dividing the interior thereof into a plurality of small chambers, said sound absorbing material being in the chambers, wherein subdivision of the interior of said cylindrical member into such small chambers increases the resonant frequency of the speaker system and permits maintaining a desired sound absorption level with less sound absorbing material.

5. The speaker system of claim 3, in which said holding means includes a pair of platelike holders, one for each of a pair of circumferentially adjacent diaphragm ends, each said platelike holder having on one side thereof a pair of side-by-side extending, spaced conductive strips insulatively separated from each other, means conductively and fixedly connecting the radially inner electrode at one said diaphragm end in overlapped relation to one said conductive strip of said holder, and conductive means spanning said insulative separation and fixedly and conductively connecting the radially outer electrode at said one diaphragm end to the other conductive strip of said holder.

6. The speaker system of claim 5, in which said cylindrical substructure assembly includes a radially opening, axially extending slot disposed circumferentially between two pairs of electrodes on said film, said film being fitted circumferentially around said cylindrical substructure assembly with said platelike holders inserted in close circumferentially spaced relation in said slot for holding the circumferential edge of said diaphragm under tension while permitting application of an alternating input signal through such holder to the associated pair of electrodes on said diaphragm, said electrode pairs being substantially diametrally opposed to each other across said cylindrical substructure assembly and being substantially of half-circular cross section, said switch means being connected between the conductive members of said holders and said input terminal means and being actuable to switch the interconnection of said electrodes and input terminal means as to change the directional response characteristic of the speaker system.

7. The speaker system of claim 2, in which said movable means of said switch means comprises ganged first and second multithrow switch members connected respectively to said input terminal means, and respective first and second sets of alternatively selectable contacts for controlling application of said input signal to one said electrode pair, said alternatively selectable contacts including one portion selectable for energizing said electrode pairs in phase, a further portion selectable for energizing said electrode pairs in the opposite phase, and a third portion selectable for de-energizing said one electrode pair, the other said electrode pair being energized, without switching, from said input terminal means.

8. The speaker system of claim 2, in which said signal path means includes first means coupling said input terminal means across one said electrode pair, and second means coupling said input terminal means across said other electrode pair and including a movable switch contact connected to an electrode of said other pair and a plurality of contacts alternatively selectable by said movable contact, said alternatively selectable contacts including a first set fed with differing fractions of an alternating input signal appearing across said input terminal means and a second set also fed with differing fractions of such alternating input signal but in opposite phase.

9. The speaker system of claim 8, in which said signal path means includes a transformer with a primary winding connected to said input terminals, said first means being a first secondary winding of said transformer connected across said first mentioned electrode pair, said second means including a second secondary winding of said transformer and having a center tap commonly connected to one electrode each of said two electrode pairs as well as to the center one of said alternatively selectable contacts, said second primary winding including further taps connected to the first set of said alternatively selectable contacts and still further taps connected to said second set of alternatively selectable contacts, the induced voltage across said secondary winding being twice that across said first secondary winding, such that actuation of said movable switch contact serially through said set of alternatively selectable contacts steps said speaker system through a plurality of differing polar sound radiation patterns.

10. The speaker system of claim 2, in which said signal path means includes electronic valve means connected across a d.c. potential source, said signal input terminal means being connected across a control electrode of said electronic valve means and one side of said d.c. potential source, a first signal system connected to a first electrode pair and a second signal system connected to a second electrode pair, means connecting the input side of one signal system to one side of said electronic valve means for receiving input signals in a first phase, said switch mean comprising a switch actuable for alternatively connecting opposite sides of said electronic valve means to said second signal system such that actuation of said switch reverses the polarity of signals applied to said second signal system, and attenuation means in series with one said signal system, whereby to switch the directional characteristics of said speaker system.

11. A piezoelectric speaker system comprising a cylindrical substructure assembly; one or more piezoelectric film with holding means connected to the both ends of the or each film; said holding means being engaged with said cylindrical substructure assembly to hold the or each film around said substructure assembly while imparting a predetermined tension the the or each film, thereby to form a cylindrical diaphragm; and a plurality of electrodes provided on each side of the diaphragm to form vibration regions of number corresponding to the number of said electrodes, input terminal means for receiving an input signal to be reproduced by said speaker system; means interconnecting said input terminal means and electrodes and including switching means actuable for switching the interconnection of at least one said electrode with respect of said input terminal means as to at least one of input signal phase and amplitude and thereby permit the user to vary the directionality of sound produced by the speaker system.

12. A piezoelectric speaker system as set forth in claim 11, wherein the respective vibration regions are applied with signals of different phases.

13. A piezoelectric speaker system as set forth in claim 12, wherein the respective vibration regions are applied with signals of different levels.

14. A piezolelectric speaker system as set forth in claim 13, wherein the respective vibration regions are applied with signals of different phases and levels.

* * * * *